United States Patent [19]

Norman

[11] Patent Number: 4,466,783

[45] Date of Patent: Aug. 21, 1984

[54] THREE VANE, TWO LOBE FLUID MOTOR

[76] Inventor: Robert W. Norman, 373 Bellefontaine Rd., Houston, Miss. 38851

[21] Appl. No.: 332,301

[22] Filed: Dec. 17, 1981

[51] Int. Cl.[3] ..... F01C 1/00; F01C 21/12

[52] U.S. Cl. ..... 418/15; 418/257

[58] Field of Search ..... 418/15, 239, 257, 258

[56] References Cited

U.S. PATENT DOCUMENTS

| | | | |
|---|---|---|---|
| 280,027 | 6/1883 | Garcelon et al. | 418/257 |
| 295,704 | 3/1884 | Wiles | 418/258 |
| 549,602 | 11/1895 | Harding | 418/257 |
| 2,565,077 | 8/1951 | Holl | 418/258 |
| 2,569,185 | 9/1951 | McKibben et al. | 418/258 |
| 3,167,023 | 1/1965 | Scognamillo | 418/257 |
| 3,909,158 | 9/1975 | Martin | 418/257 |

FOREIGN PATENT DOCUMENTS

| | | | |
|---|---|---|---|
| 173390 | 11/1960 | Sweden | 418/257 |

*Primary Examiner*—John J. Vrablik

*Attorney, Agent, or Firm*—Harvey B. Jacobson

[57] ABSTRACT

A hollow housing is provided having opposite ends and defining a cavity within the housing including two slightly greater than one-half cylindrical portions opening toward and into each other and defining a pair of opposite lobes projecting inwardly of opposite sides of the cavity. The opposite ends of the housing are closed by spaced apart end walls between which the cavity is defined and a cylindrical rotor is journalled in the cavity for rotation about an axis at least substantially lying upon a straight line extending between the lobes and with the axis spaced equal distances from the lobes substantially equaling the radius of curvature of the rotor. The rotor has a central cavity therein spaced inward of the outer periphery of the rotor and three substantially equally angularly spaced and generally radial slots are formed in the rotor and extend axially therethrough with the inner ends of the slots opening into the cavity. Three vanes are slidably received in the slots and have their inner ends projecting into the cavity and a cylindrical ring is loosely disposed in the cavity and loosely engages the inner ends of the vanes. Suitable fluid intake ports are disposed on the departure sides of the lobes and fluid exhaust ports disposed on the approach sides of the lobes with external valving being provided to convert the intake ports into outlet ports and the outlet ports into intake ports.

9 Claims, 5 Drawing Figures

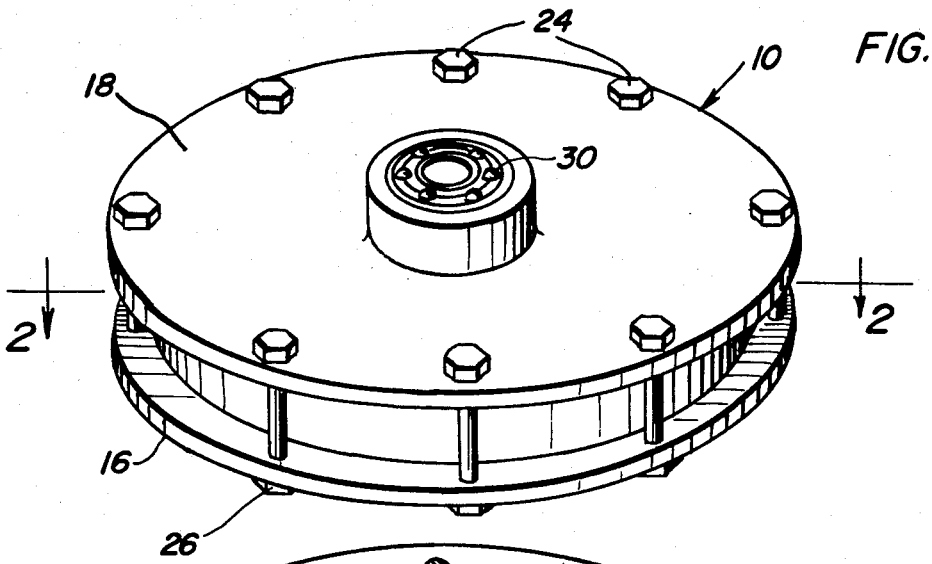
FIG. 1
FIG. 2
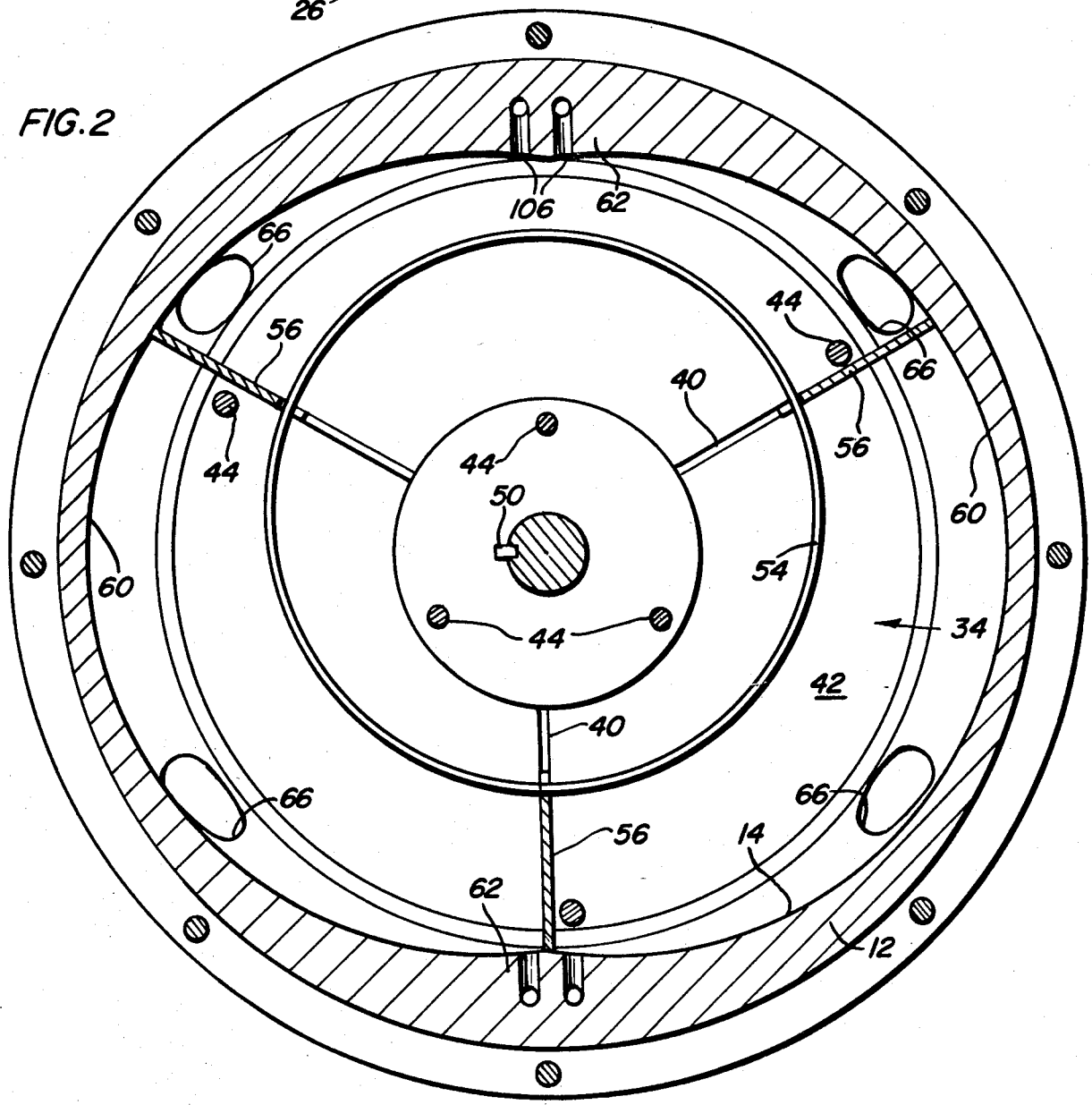

THREE VANE, TWO LOBE FLUID MOTOR

BACKGROUND OF THE INVENTION

Various forms of sliding vane rotary fluid motors heretofore have been provided and many of these previously known sliding vane fluid motors have been constructed for selective rotation in either direction. However, sliding vane rotary motors often include springs to yieldingly bias the vanes thereof toward outermost limit positions and while the operation of such springs is efficient during outward movement of the vanes, it causes excessive wear on the outer ends of the vanes and on the associated rotor cavity walls during inward movement of the vanes. Accordingly, a need exists for a sliding vane rotary motor equipped with rotor mounted structure whereby outward movement of the vanes relative to the motor may be effected by means other than springs and inward movement of the vanes relative to the rotor will not be resisted by spring pressure.

Examples of various forms of sliding vane rotary motors including some of the general structural and operational features of the instant invention are disclosed in U.S. Pat. Nos. 836,768, 889,092, 1,006,035, 2,233,269, 2,345,561, 3,323,501, 3,343,782, 3,451,381 and 3,952,709.

BRIEF DESCRIPTION OF THE INVENTION

The fluid motor of the instant invention is constructed in a manner whereby the directional rotation of the rotor thereof may be readily reversed and it is further constructed in a manner whereby inward movement of one of the sliding vanes thereof automatically effects outward movement of one of the other vanes thereof. The connection between an inward moving vane and an outward moving vane is effected by a ring contained within a central cavity formed in the rotor into which radial vane slots open and the vanes of the rotor are slidable in respective radial slots and each engageable with an adjacent portion of the ring for inward displacement thereof responsive to inward displacement of the vane to effect at least initial outward movement of another vane of the rotor. In this manner, more effective vane "tracking" relative to the outer wall portions of the rotor chamber is effected.

The main object of this invention is to provide a fluid motor including structure by which the direction of rotation of the rotor thereof may be quickly reversed.

Another important object of this invention is to provide a rotary motor incorporating a novel lost motion connection between the sliding vanes thereof whereby inward movement of one of the vanes will automatically effect at least initial outward movement of another vane thereof.

Yet another object of this invention is to provide a fluid motor incorporating structural features thereof which enable the fluid motor to be readily rebuilt, when necessary, to renew the original efficiency thereof.

A final object of this invention to be specifically enumerated herein is to provide a fluid motor in accordance with the preceding objects and which will conform to conventional forms to manufacture, be of simple construction and dependable in operation so as to provide a device that will be economically feasible, long lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the fluid motor;

FIG. 2 is an enlarged fragmentary section view taken substantially upon a plane indicated by the section line 2—2 of FIG. 1;

DETAILED DESCRIPTION OF THE INVENTION

Figure 3:
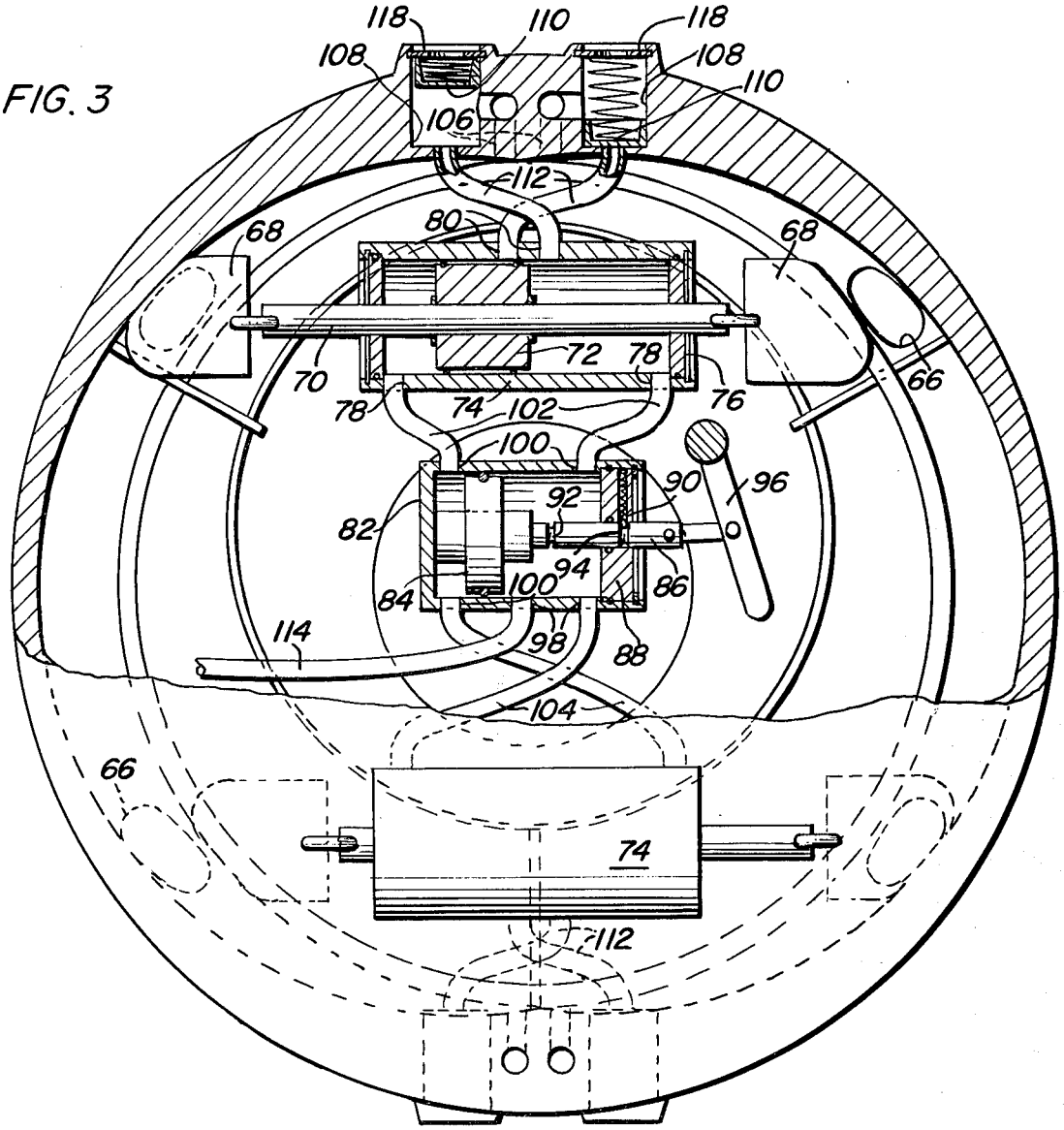
FIG. 3 is an elevational schematic view of the reversing valve equipped end of the motor with portions of the adjacent end wall and reversing valve structure broken away and illustrated in vertical section.

Referring now more specifically to the drawings, the numeral 10 generally designates the fluid motor of the instant invention. The motor 10 includes a generally cylindrical open-ended housing 12 defining an axially extending cavity 14 therein. The opposite ends of the cavity 14 are closed by end plates 16 and 18 having central journal bores 20 and 22 formed therethrough.

The end plates 16 and 18 are of greater transverse dimensions than the housing 12 and the peripheral portions of the end plates 16 and 18 project outwardly of the corresponding peripheral portions of the housing 12. Clamp bolts 24 are secured through the end plates 16 and 18 by threaded nuts 26. The journal bores 20 and 22 including bearings 28 and 30 disposed therein and the bearings 28 and 30 rotatably journal opposite end portions of a rotor shaft 32 upon which the rotor assembly 34 comprising a pair of half rotor sections 36 and 38 is mounted for rotation therewith.

Each rotor half 36 and 38 has three equally circumferentially spaced radial slots 40 formed therein and further defines an annular cavity 42 formed therein. The annular cavities 42 open toward each other and together define a ring receiving cavity when the rotor halves 36 and 38 are secured together through the utilization of fasteners 44 provided for that purpose. The rotor halves 36 and 38 include registered keyways 46 and the shaft 32 includes a keyway 48. When the rotor assembly 34 is mounted on the shaft 32, the keyways 46 are registered with the keyway 48 and a key 50 is received in the keyways 46 and 48 and serves to lock the rotor assembly 34 to the shaft 32 for rotation therewith.

An annular ring 54 is loosely received in the cavities 42 and a vane 56 is slidably disposed in each pair of corresponding slots 40, the latter extending inwardly into the cavities 42. The inner ends of the vanes 56 are provided with inwardly opening notches 58 in which adjacent portions of the ring 54 are disposed.

The cavity 14 is defines by a pair of slightly greater than one-half cylindrical cavity sections 60 formed in the housing 12. The centers of curvature of the cavity sections 60 are equally spaced on opposite sides of the axis of rotation of the shaft 32 and, accordingly, the cavity 14 includes diametrically opposite inwardly projecting lobes 62. The minimum spacing between the lobes 62 is only slightly greater than the diameter of the cylindrical rotor 34 and the blades 56 sweep the portions of the cavity sections 60 disposed outwardly of the rotor 34.

The opposite ends of each of the cavity sections 60 disposed outwardly of the rotor 34 include exhaust outlet ports 66 formed through the end plate 16 and the outer end of each exhaust port 66 has a slide valve 68 operatively associated therewith. Each pair of slide valves 66 adjacent a corresponding lobe 62 is interconnected by a piston rod 70 extending therebetween having a seal equipped piston 72 mounted on its end portion. Each piston 72 is slidably received in a valve cylinder 74 having removable end plates 76 equipped with suitable seals. Each cylinder 74 includes a pair of fluid pressure inlets 78 at the opposite ends thereof and a pair of fluid pressure outlets 80 closely spaced on opposite sides of the longitudinal center of the cylinder 74.

In addition, the end plate 16 includes an exteriorly mounted reversing valve cylinder 82 having a seal equipped piston 84 slidably disposed therein and mounted on a piston rod 86 projecting outwardly through one removable end wall 88 of the cylinder 82 equipped with a spring biased detent member 90. The detent member 90 is selectably engageable in either one of a pair of detent grooves 92 and 94 formed in the piston rod 86 and the outer end of the piston rod 86 is pivot link attached to an operating lever 96 pivotally supported from the exterior of the end plates 16.

The reversing valve cylinder 82 includes an inlet port 98 and opposite end pairs of outlet ports 100. One pair of outlet ports 100 are communicated with the fluid pressure inlets 78 of one of the valves cylinders 74 by lines 102 and a second pair of lines 104 communicate the other pair of outlet ports 100 with the fluid pressure inlet 78 of the other valve cylinder 74. Further, the diametrically opposite portions of the housing 12 defining the lobes 62 include two sets of combined inlets and exhaust port 106 and each pair of outlet ports is under the control of a valve chamber 108 having a spring biased check valve 110 slidably disposed therein. A pair of lines 112 communicate each pair of outlet ports 80 with the corresponding valve chambers 108. Also, a fluid pressure supply line 114 opens into the reversing valve cylinder 82 through the inlet port 98.

In operation, when the lever 96 is positioned as illustrated in FIG. 3, fluid under pressure enters the cylinder 82 through the line 114 and the inlet 98. Thereafter, the fluid pressure passes into opposite ends of the valve cylinders 74 from the right-hand end of the cylinder 82 through the corresponding lines 102 and 104. This causes the pistons in the upper and lower cylinders 74 illustrated in FIG. 3 to move to the left and right, respectively, and the fluid pressure is therefore exhausted from the right- and left-hand ends of the upper and lower cylinders 74 illustrated in FIG. 3 through the corresponding lines 112 and into the associated chambers 108. Accordingly, the fluid under pressure is discharged into the portions of the chamber sections 60 disposed outwardly of the rotor assembly 34 disposed to the left of the upper lobe 62 and to the right of the lower lobe 62 illustrated in FIG. 3 and thereby causes the rotor assembly 34 to rotate in a counterclockwise direction. It will be noted that the check valves 110 disposed in the corresponding chambers 108 are outwardly displaced thereby providing communication between the corresponding lines 112 and the associated ports 106. In addition, the piston rods 70 have opened the upper right and lower left side valves 68 (see FIG. 3) thereby enabling fluid under pressure to be exhausted from the chamber sections 60 through the upper right and lower left exhaust ports 66 illustrated in FIG. 3. In addition, the upper right and lower ports 106 illustrated in FIG. 3 also function as exhaust ports with the fluid pressure entering those exhaust ports 106 and passing into the corresponding valve chambers 108 and outwardly through the apertured spring retaining end plates 118. The fluid being exhausted through the ports 106 serving as exhaust ports supplements the spring pressure acting on the corresponding check valves 110 and maintains those valves in the closed positions.

Of course, if the lower free end of the lever 96 is swung to the right as viewed in FIG. 3 of the drawings and the piston 84 is correspondingly shifted to the right, the right-hand outlet ports 100 will be maintained out of communication with the inlet port 98 and the left-hand outlet ports 100 will be communicated with the inlet port 98. Therefore, the upper and lower piston rods 70 will be shifted toward the right and left, respectively, and the rotor 34 will be caused to rotate in a clockwise direction.

Figure 4:
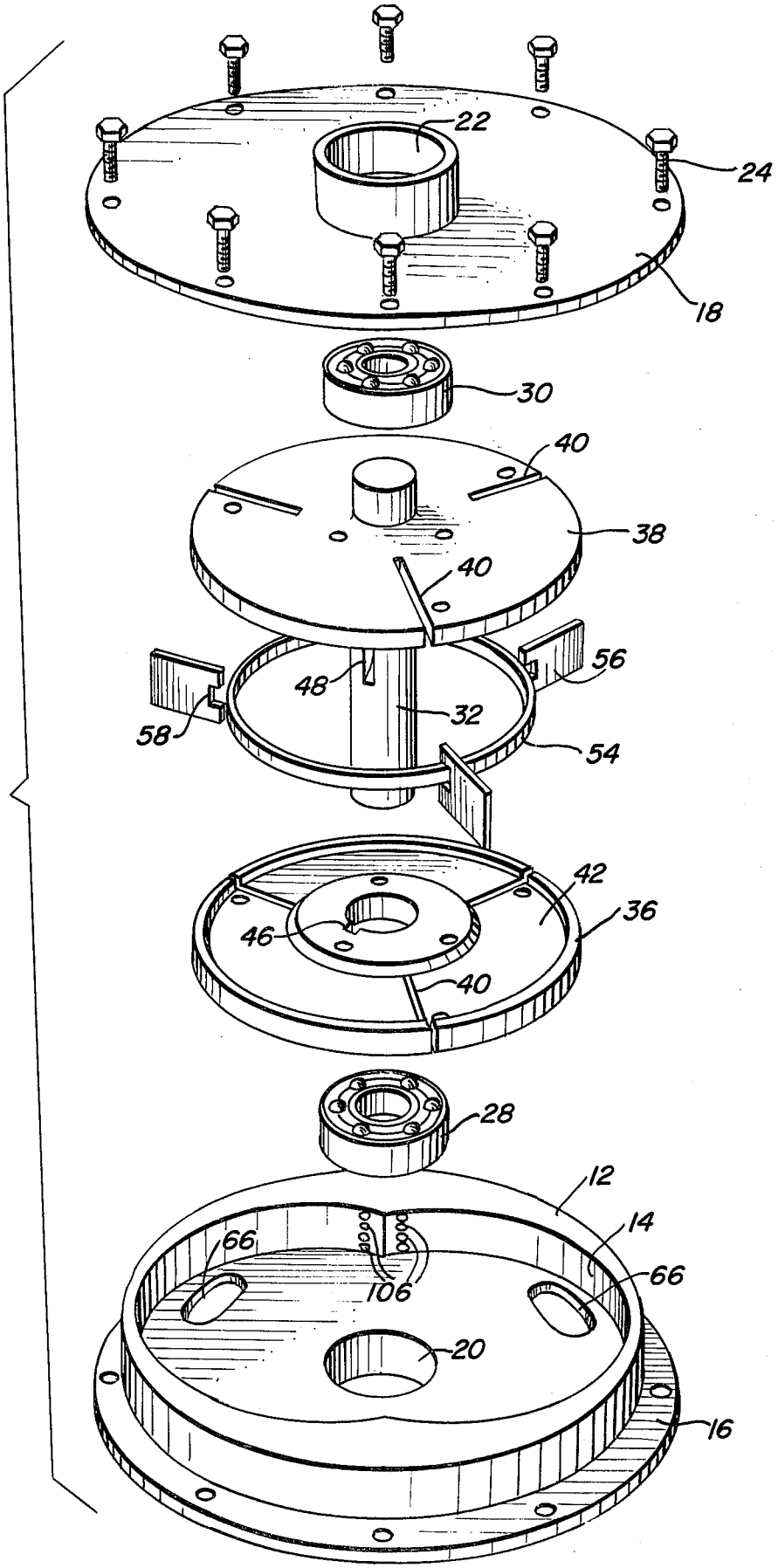
FIG. 4 is an exploded perspective view of the fluid motor.

With attention invited now more specifically to FIGS. 2 and 4 of the drawings, it may be seen that the inner ends of the vanes 56 are abutted by the outer surface portions of adjacent portions of the ring 54 whereby inward movement of the upper right-hand vane 56 in FIG. 2 during counterclockwise rotation of the rotor 34 will cause the ring 54 to be shifted to the left and downwardly, whereby the upper left-hand vane 56 and the lower vane 56 illustrated in FIG. 2 will be urged radially outwardly of the rotor 34 so as to be maintained in contact with the outer walls of the corresponding cavity sections 60.

Thus, when the motor 10 is operating at low speeds, the vanes 56 are automatically outwardly biased on the departure sides of the lobes 62 without the use of expansion springs which tend to increase wear between the vanes 56 and the outer surfaces of the cavity sections 60 on the approach sides of the lobes 62.

Figure 5:
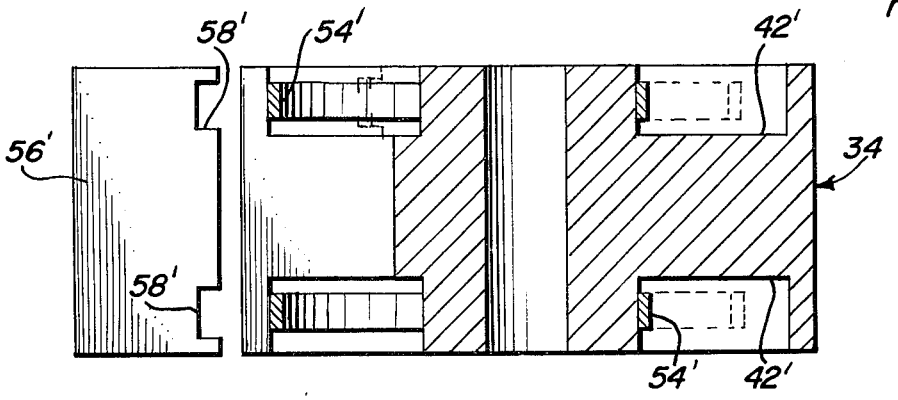
FIG. 5 is a diametric sectional view of a modified form of rotor illustrating one of the vanes thereof in detached position.

With attention now invited more specifically to FIG. 5 of the drawings, there may be seen a modified form of rotor assembly 34'. The rotor assembly 34' is of one-piece construction and, instead of being of two-piece construction with a pair of annular cavities 42 formed in adjacent sides in order to form a single central cavity therein, the rotor assembly 34' includes opposite end cavities 42' each having a corresponding ring 54' received therein. Further, the rotor assembly 34' is equipped with vanes 56' corresponding to the vanes 58 but which include a pair of notches 58' for receiving corresponding portions of the associated rings 54' therein.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A rotary motor including a hollow housing having opposite ends and defining a cavity within said housing including two slightly greater than one-half cylindrical portions opening toward and into each other and defining a pair of opposite lobes projecting inwardly of opposite sides of the cavity, the opposite ends of said housing being closed by spaced apart end walls between which said cavity is defined, a cylindrical rotor journaled in said cavity for rotation about an axis at least substantially lying upon a straight line extending between the lobes and with said axis spaced from said lobes distances substantially equaling the radius of said rotor, said rotor defining a cylindrical disk-shaped body having at least one central cavity therein spaced inward of the outer periphery of said rotor, three substantially equally angularly spaced apart and generally radial slots formed in said rotor extending axially therethrough and opening radially inwardly into said rotor cavity, three vanes slidably received in said slots and having inner ends projecting into said rotor cavity, a cylindrical radial thrust transmitting ring loosely disposed in said rotor cavity for shifting therein in all directions in a plane disposed normal to said axis, the inner end of each vane being disposed for engagement with the adjacent periphery portion of said ring for inwardly shifting that peripheral portion toward said axis responsive to inward radial shifting of the last-mentioned vane, and fluid inlet and exhaust means opening into and out of each of said one-half cylindrical cavity portions outward of said rotor.

2. The rotary motor of claim 1 wherein the inner ends of said vanes include notches formed therein, adjacent peripheral portions of said ring being loosely received in said notches.

3. The rotary motor of claim 1 including valve means operatively associated with said fluid inlet and exhaust means operative to selectively render said fluid inlet means, fluid outlet means and said fluid exhaust means fluid inlet means, whereby direction of rotation of said rotor may be reversed.

4. The rotary motor of claim 1 including means operatively connected between said end walls operative to clamp said housing between said end walls.

5. The rotary motor of claim 1 wherein said motor includes a central cavity formed in each of the axial ends thereof, each of said vanes including a pair of inwardly opening notches formed in the inner ends thereof, a ring disposed in each of said rotar cavities, each notch in each of said vanes loosely receiving an adjacent peripheral portion of the associated ring therein.

6. The rotary motor of claim 5 including valve means operatively associated with said fluid inlet and exhaust means operative to selectively render said fluid inlet means, fluid outlet means and said fluid exhaust means fluid inlet means, whereby direction of rotation of said rotor may be reversed.

7. The rotary motor of claim 6 including means operatively connected between said end walls operative to clamp said housing between said end walls.

8. The rotary motor of claim 1 wherein said fluid inlet and exhaust means each comprise a plurality of ports opening into corresponding one-half cylindrical cavity portion closely adjacent the apex portion of the corresponding lobe and with said ports spaced apart axially of the axis of rotation of said rotor.

9. The rotary motor of claim 8 wherein each of said one-half cylindrical portions of said cavity include a pair of selectively openable and closable supplemental fluid exhaust ports opening axially thereinto outwardly of said rotor at points angularly disposed proximately 45° from the apex portions of said lobes, valve means operatively associated with said fluid inlet and exhaust means operative to selectively render said fluid inlet means fluid exhaust means and said fluid exhaust means fluid inlet means, whereby direction of rotation of said rotor may be reversed, said valve means also including means for inversely opening and closing said pair of supplemental exhaust ports in conjunction with operation of said valve means.

* * * * *